US006976594B1

(12) United States Patent
Young

(10) Patent No.: US 6,976,594 B1
(45) Date of Patent: Dec. 20, 2005

(54) CYLINDER HOLDER FOR IMPACT RESISTANT STORAGE

(76) Inventor: Richard E. Young, P.O. Box 306, Lancaster, NY (US) 14086

( * ) Notice: Subject to any disclaimer, the term of this patent is extended or adjusted under 35 U.S.C. 154(b) by 160 days.

(21) Appl. No.: 10/672,092

(22) Filed: Sep. 26, 2003

(51) Int. Cl.[7] ..... A47G 29/00
(52) U.S. Cl. ..... 211/85.18; 211/194
(58) Field of Search ..... 211/85.18, 85.19, 211/85.21, 85.22, 60.1, 74, 194; 206/443, 206/446, 592, 591, 583; 248/565, 566, 560

(56) References Cited

U.S. PATENT DOCUMENTS 3,602,368 A * 8/1971 Gould ..... 206/598
3,643,813 A * 2/1972 Noonan ..... 211/75
4,391,377 A * 7/1983 Ziaylek, Jr. ..... 211/85.18
4,564,109 A * 1/1986 Stavlo ..... 206/597
6,340,105 B1 * 1/2002 Black ..... 224/404
6,405,882 B1 * 6/2002 Baxter ..... 211/85.18
6,494,549 B2 * 12/2002 Van Daalwyk ..... 312/72

* cited by examiner

*Primary Examiner*—David Purol

(57) ABSTRACT

Impact resistant storage of cylinders in a cylinder holder having a body, means to contain the cylinder longitudinally and means to resiliently position the cylinder laterally. The body has a cavity to receive the cylinder. The cavity has a longitudinal central axis generally corresponding to a longitudinal axis of the cylinder. The means to contain the cylinder longitudinally provides for a resilient containment of the cylinder within the cavity during periods of longitudinal stress. The means to position the cylinder laterally provides for a resilient positioning of the cylinder within the cavity wherein the longitudinal axis of the cylinder may move laterally within a three hundred and sixty (360) degree radial range away from the longitudinal central axis of the cavity during periods of lateral stress and return generally to the longitudinal central axis of the cavity following termination of the lateral stress.

20 Claims, 6 Drawing Sheets

FIG. 5
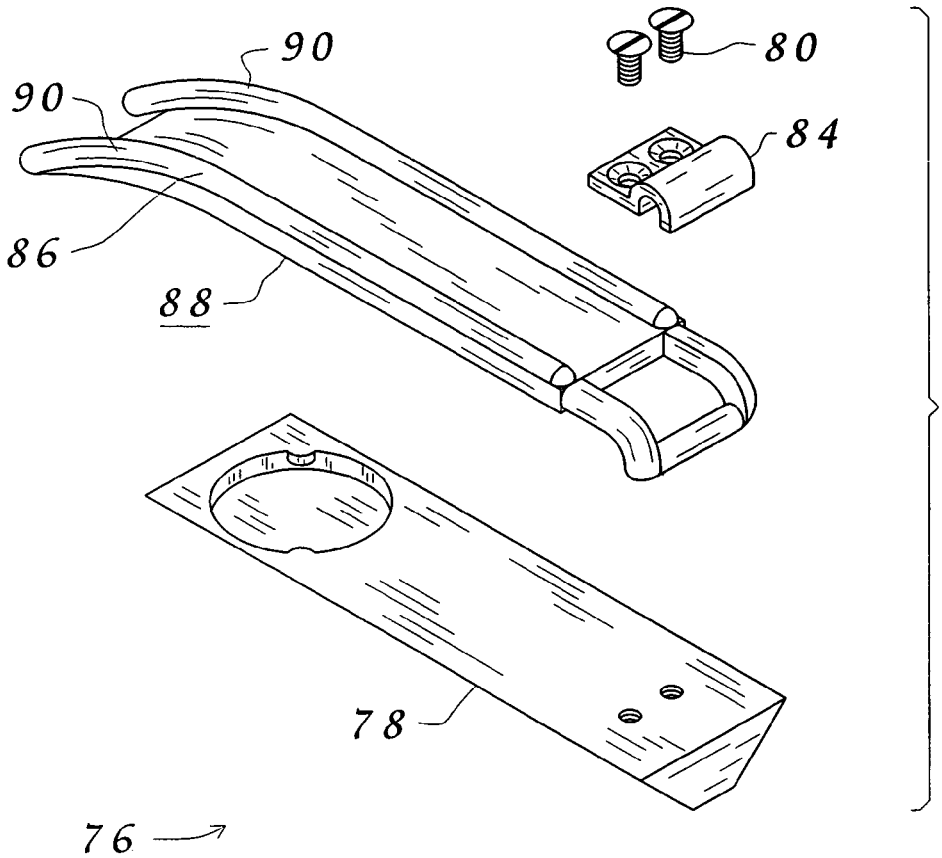
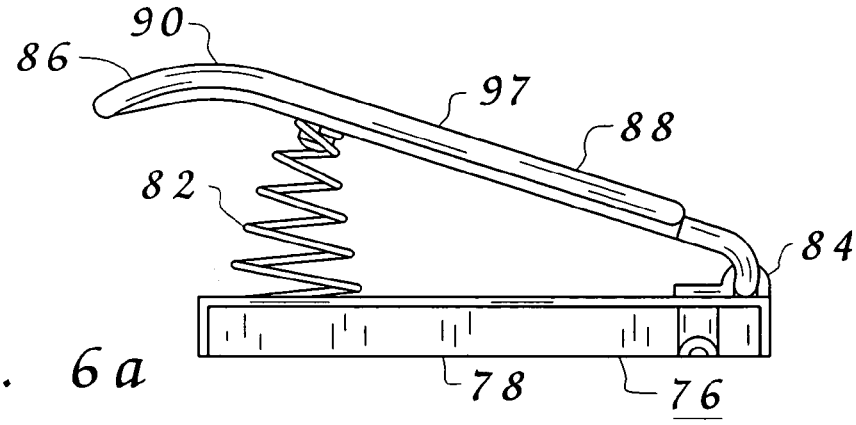
FIG. 6a
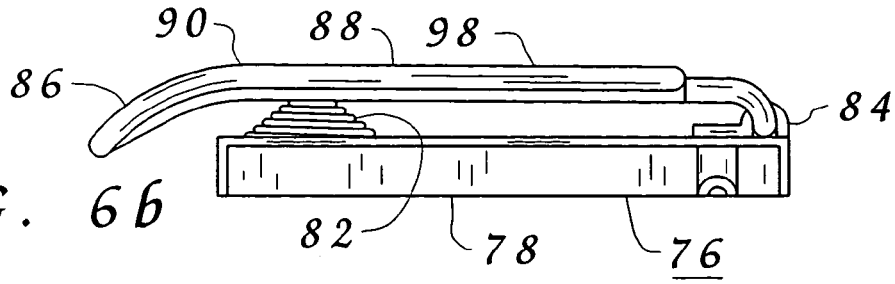
FIG. 6b

FIG. 8
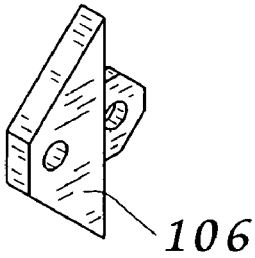
FIG. 9
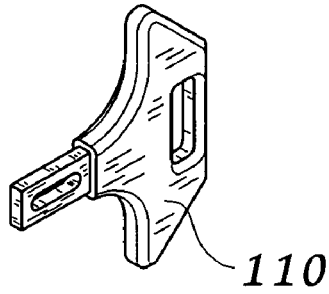
FIG. 10
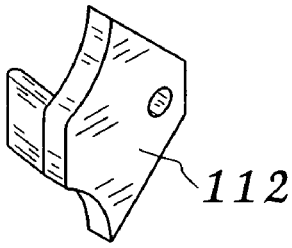
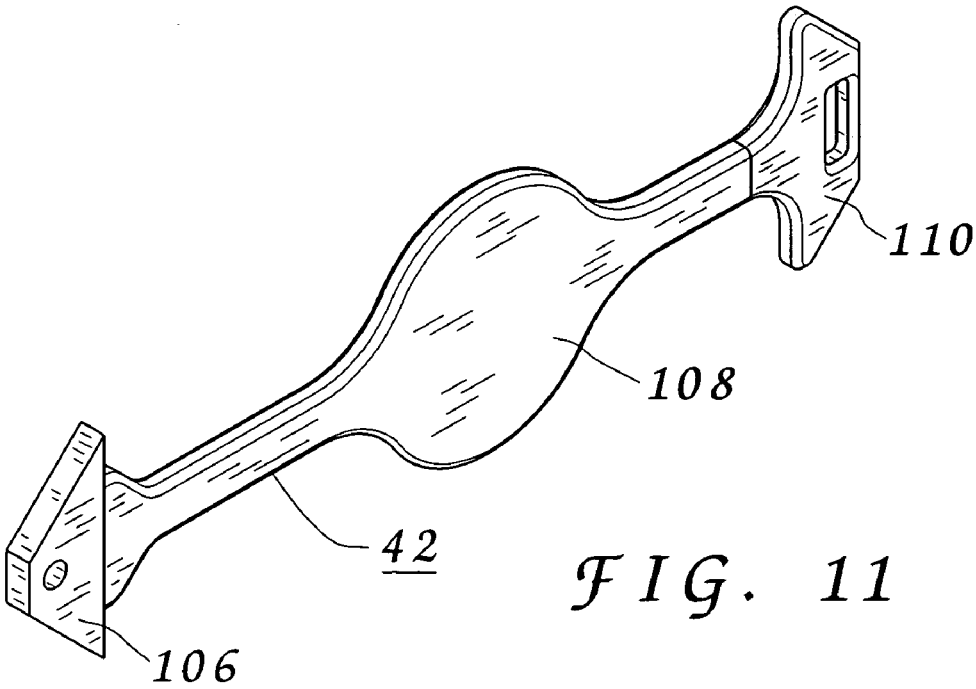
FIG. 11

CYLINDER HOLDER FOR IMPACT RESISTANT STORAGE

BACKGROUND

1. Field of the Invention

Generally, the invention relates to cylinder holders for cylinders. More specifically, the invention relates to such cylinder holders which provide general protection to the cylinders and which also resiliently retain the cylinders therein to isolate them from potential damage resulting from severe impact to and/or severe jarring of the cylinder holder.

2. Description of the Prior Art

Cylinders containing gases under pressure are well known. Such cylinders come in many sizes and lengths and may contain various types of gases for various useful purposes. Depending upon the type of material and the desired use the cylinder may retain the material under extremely high pressure. One example of this very high pressure cylinder storage involves air tanks for emergency personnel. Numerous methods exist to store cylinders. These include simple rack storage and simple cabinet storage. These types of storage typically are intended to merely provide a convenient place for storage while maintaining the cylinders in an orderly arrangement. Typically little thought is given to protecting the cylinders from damage resulting from trauma directed to the storage medium. Additionally, very high pressure cylinders typically are lightweight aluminum shell cylinders wrapped with high strength carbon or 'KEVLAR' fibers. When this type of cylinder is stored structural components of the storage system may cut or wear the fibers weakening the cylinders and reducing their useful life.

Various deficiencies exist with the conventional storage methods known for cylinders. Severe impact or severe jarring of the rack or cabinet may be directly transferred to the stored cylinders. As such, it may be appreciated that there continues to be a need for a cylinder holder which provides superior protection to stored cylinders including insolation of the stored cylinders from trauma direct to the cylinder holder while permitting independent ready access to individual stored cylinders. The present invention substantially fulfills these needs.

SUMMARY

In view of the foregoing disadvantages inherent in the known storage methods for cylinders, your applicant has devised a cylinder holder for retaining a cylinder for impact resistant storage of the cylinder. The cylinder holder has a body, means to contain the cylinder longitudinally and means to resiliently position the cylinder laterally. The body has a cavity to receive the cylinder. The cavity has a longitudinal central axis generally corresponding to a longitudinal axis of the cylinder when the cylinder is positioned within the cavity during impact resistant storage. The means to contain the cylinder longitudinally provides for a resilient containment of the cylinder within the cavity of the body of the cylinder holder during periods of generally longitudinal stress. The means to resiliently position the cylinder laterally provides for a resilient positioning of the cylinder within the cavity of the body wherein the longitudinal axis of the cylinder may move laterally within a three hundred and sixty (360) degree radial range away from the longitudinal central axis of the cavity of the body during periods of generally lateral stress and return generally to the longitudinal central axis of the cavity following termination of the lateral stress.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for storage of high pressure cylinders within a cylinder holder in a safe manner where stress and/or trauma to the cylinder holder is not transferred to the high pressure cylinder.

Other objects include:

a) to provide for safe secure storage of a cylinder while providing for easy release from the cylinder holder even while wearing heavy protective gloves.

b) to provide for a cylinder holder formed primarily of plastics and stainless steel to permit extended use of the cylinder holder in abusive operating environments including those encountered on ships at sea.

c) to provide for the cylinder holder to have cylinder contact surfaces of a construction which will not cut or wear through the coating of the cylinder, including those coatings having a fiber material, such as 'KEVLAR', incorporated therein.

d) to provide for protection for any attached mechanisms of the cylinder, including the pressure gauge, while providing for visual access to read the pressure gauge of the cylinder without requiring release of the cylinder from the cylinder holder.

e) to provide for the body of the cylinder holder to be formed from two generally identical molded shell components.

f) to provide for storage of the cylinder in a cylinder holder having features of the present invention in any desired angular orientation including horizontal and vertical.

g) to provide for a plurality of automatic adjusting slide assemblies attached relative to the body of the cylinder holder to provide for the centering retention of the cylinder where the cylinder may move about within the cylinder holder in response to jarring of the cylinder holder to isolate the cylinder from any damage typically associated with such jarring.

h) to provide for use of a stainless steel progressive spring for each of the automatic adjusting slide assemblies where suitable bearing pressure is applied to the cylinder without regard for the diametric measurement of the cylinder within a range of suitably sized cylinders.

i) to provide for a first radially disposed ring of automatic adjusting slide assemblies positioned in close proximity to the access end of the cylinder holder and a second radially disposed ring of automatic adjusting slide assemblies positioned inward from the first radially disposed ring of automatic adjusting slide assemblies.

j) to provide for the slide member of each automatic adjusting slide assembly to have opposing cylinder bearing positions to distribute contact with the cylinder to minimize wear to any coating of the cylinder during insertion, retention and removal of the cylinder from the cylinder holder.

k) to provide for assembly of a plurality of cylinder holders having features of the present invention into an array of cylinder holders for rack type storage of a plurality of cylinders.

l) to provide for service passageways and mounting apertures through the body of the cylinder holder to provide for easy assembly of the plurality of cylinder holders into the array of cylinder holders.

m) to provide for assembly of the plurality of cylinder holders into the array of cylinder holders using a minimal number of tools.

n) to provide for multiple sets of outer corner tabs and backing corner tabs spaced slightly apart and having a slot therebetween and positioned on the body of the cylinder holder in close proximity to the opening at the access end where a select pair of the slots will receive components of an elastomer strap assembly for secure anchoring thereof to the body of the cylinder holder.

o) to provide for strengthening gussets spanning select adjacent walls of the body of the cylinder holder to enhance structural integrity.

p) to provide for a resilient pad to be positioned within the body of the cylinder holder distal from the access end to contact and cushion the base of the cylinder positioned within the cylinder holder.

q) to provide for drains within the body of the cylinder holder to prevent retention of liquids within the cylinder holder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 5 is an exploded perspective view of a slide assembly.

FIG. 6*a* and FIG. 6*b* are side elevational view of the slide assembly shown in FIG. 5 and depicted in opposing operational positions within a range of operational motion.

FIG. 8 is a perspective view of a fixed strap mount.

FIG. 9 is a perspective view of a lock strap portion.

FIG. 10 is a perspective view of an angled coupling.

FIG. 11 is a perspective view of a restraining strap having the fixed strap mount positioned at one end and the lock strap portion positioned at the opposing end.

DESCRIPTION

Figure 1:
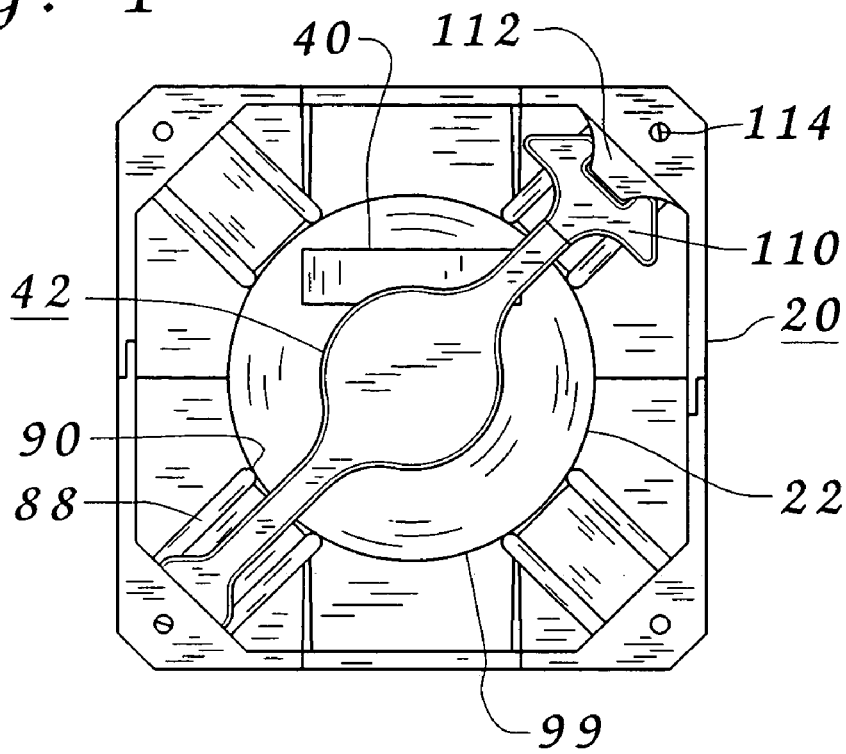
FIG. 1 is a front elevational view of a cylinder holder having a cylinder stored therein.

Many different cylinder holders having features of the present invention are possible. The following description describes the preferred embodiment of select features of those cylinder holders and various combinations thereof. These features may be deployed in various combinations to arrive at various desired working configurations of cylinder holders. The preferred embodiment of the 'Cylinder Mate' depicted has been produced and is the result of extensive engineering and testing.

Reference is hereafter made to the drawings where like reference numerals refer to like parts throughout the various views.

Cylinders

The encasement storage of cylinders has several requirements. These include: 1) providing a storage unit durable enough to operate in the desired environment, including extreme environments; 2) providing for accessibility to the stored cylinder, including easy release of the stored cylinder from the storage unit; 3) providing protection to the stored cylinder from striking damage; 4) providing for containment of the cylinder within the storage unit where that containment does not damage the exterior of the stored cylinder, including any fiber wrappings, and; 5) isolating the stored cylinder from any movement, such as vibration or shock loads, delivered to the storage unit. As will be readily seen cylinder holders having features of the present invention provide for these requirements in a unique and extraordinary manner.

Often a plurality of cylinders will be stored in a single location, without regard for whether that storage location is fixed or mobile. Often various sizes of cylinders, and therefore storage capacities, will be provided at a specific location to provide the user with usage options. Cylinders to be stored in a specific cylinder holder having features of the present invention may be of various diametric sizes. That is to say the specific cylinder holder will be capable of accommodating cylinders within a range of diametric sizes.

While not limited to use with high pressure cylinders, those with pressure in the forty-five hundred (4500) psi range, cylinder holders having features of the present invention are well suited to storage of such cylinders. Typically such high pressure cylinders are lightweight aluminum shell cylinders wrapped with high strength carbon or 'KEVLAR' fibers and are used to store compressed air. Such high pressure compressed air cylinders are used as air supplies for various purposes including as a source of breathable air in emergency situations.

Cylinders typically have a pressure gauge which is used during routine inspection of the cylinder and used during actual use of the cylinder to determine remaining capacity. During the storage of the cylinder it is desirable to be able to visually access and read the pressure gauge to determine the pressure of the cylinder without requiring manipulation of either the storage means or the actual cylinder.

Many applicable cylinders have a smooth curved base distal from the end of the cylinder having the mechanical coupling extending therefrom. These cylinders have no lip or other protrusions which must interact with structures of the cylinder holder having features of the present invention during insertion, storage or withdrawal of the cylinder from the cylinder holder. Certain applicable cylinders have a structural bead or band extending radially around the cylinder. Such bead or band may be part of the cylinder proper or part of an attachable base which is secured to the cylinder. Such radially positioned protrusions typically extend outward from a side wall of the cylinder and typically are positioned near or at the transition of the side wall of the cylinder to the end of the cylinder. When such a protrusion is positioned on the workpiece cylinder it is a requirement that this protrusion not bind with structures of the cylinder holder during insertion, storage or removal of the cylinder from the cylinder holder. As more fully detailed below structural configurations of the slide assembly provides for passage of the cylinder into and out of the cylinder holder without undue concern for traumatic engagement of this radial protrusion relative to the cylinder holder.

Figure 2:
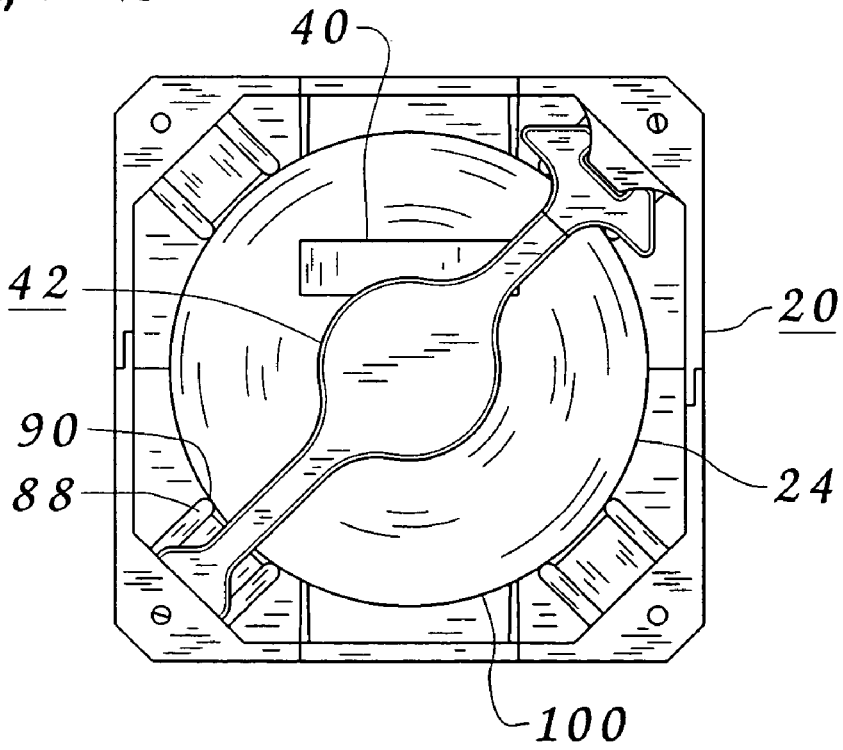
FIG. 2 is a front elevational view of the cylinder holder shown in FIG. 1 with a larger cylinder stored therein.

FIG. 1 depicts a cylinder holder 20, a 'Cylinder Mate', having a cylinder 22, a workpiece cylinder, stored therein. FIG. 2 depicts cylinder holder 20 having a cylinder 24, stored therein. It being noted that cylinder 22 has a small diametric measurement, and therefore a smaller capacity, than the diametric measurement of cylinder 24. Cylinder holder 20 is versatile enough to properly contain and store cylinders having a diametric measurements within a range of measurements, including those of cylinder 22 and cylinder 24.

Overview of Cylinder Holder

Cylinder holders having features of the present invention retain cylinders for secure containment and impact resistant storage of the cylinder. In use a cylinder is inserted into the cylinder holder, the cylinder is stored in the cylinder holder for a period of time and the cylinder is removed from the cylinder holder. Often this sequence is repeated over and over during the life of the cylinder. As an example, naval personnel may repeatedly remove and replace a specific cylinder during routine training operations. Cylinder holders having features of the present invention will provide for insertion, retention and removal of the cylinder from the cylinder holder while protecting the cylinder from damage. Such damage including damage to the exterior of the cylinder, including any protective fiber wrapping, damage to the cylinder from being directly struck while in the cylinder holder and damage to the cylinder from the effects of shaking, vibration or jarring inflicted upon the cylinder holder.

Due to the construction of cylinder holders having features of the present invention they may be used in extremely abusive environments and in any desired angular orientation, including horizontal and vertical. They are non-corrosive and resistant to salt air, salt water, fuels, oils and may operate from about negative twenty-five (−25) degrees Fahrenheit to about one hundred and seventy-five (175) degrees Fahrenheit. As disclosed elsewhere, often a plurality of cylinder holders will be assembled to form an array of cylinder holders in rack form.

Figure 3:
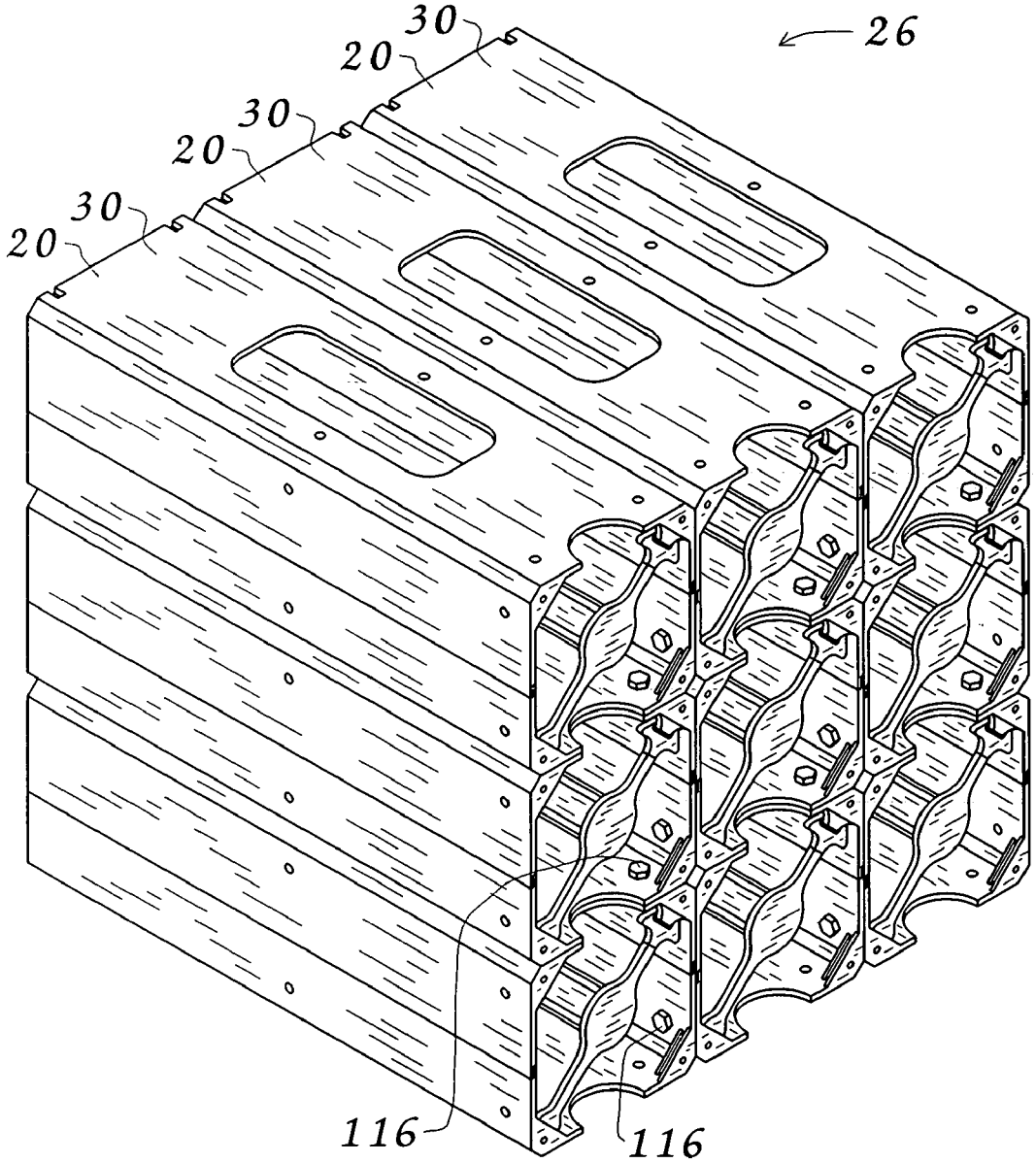
FIG. 3 is a perspective view of an array of cylinder holders.

FIG. 1 depicts a single cylinder holder 20 capable of storing one (1) cylinder. FIG. 3 depicts an array of cylinder holders 26 having nine (9) cylinder holders 20 and capable of storing nine (9) cylinders, not shown in this view. Of course an array of cylinder holders may be formed capable of storing any desired number of cylinders from two (2) cylinders upward to any desired number of cylinders.

Body

Each cylinder holder having features of the present invention will have a body having a cavity, or interior, and an opening at an access end into the cavity. Cylinders applicable to the present invention have a longitudinal length significantly greater than a diameter of the cylinder. Each cylinder to be stored will have a longitudinal axis therethrough. While it is possible to provide for storage of cylinders within the cylinder holder where the longitudinal axis of the cylinder does not align with a longitudinal axis, or central axis, of the cavity of the cylinder holder, preferably these axises will align during storage of the cylinder.

Means will be provided to attach other components, disclosed elsewhere herein, to the body of the cylinder holder. Preferably means will be provided to attach a plurality of the bodies together to form an array of cylinder holders. In a preferred embodiment mounting apertures penetrate select wall members of the body to provide for ready and secure coupling of multiple cylinder holders together using a minimum of tools while keeping the coupling hardware well away from the stored cylinder. Stainless steel bolts and nuts preferably are used to securely attach a cylinder holder to an adjacent cylinder holder. Similarly, stainless steel bolts and nuts are preferred to attach other components to the cylinder holder or to attach the cylinder holder to other structures. Preferably at least one (1), and preferably two (2), service passageways will be provide through the body to provide for ready access to the cavity of the body. This is particularly desirable during assembly of the cylinder holder and during assembly of an array of cylinder holders. Preferably adequate drainage will be provided in the form of drainage apertures through the body where fluids may not gather and reside within the cylinder holder. Preferably a pressure gauge view area will be provided on the body to provide for ready viewing of a pressure gauge of a cylinder positioned and contained within the cylinder holder. Due to a strong desire to fully contain the entire cylinder, including the pressure gauge, within the cylinder holder, at least one (1) indentation in the form of the pressure gauge view area, and preferably opposing indentations, are provided. Even when a plurality of cylinder holders are assembled into an array of cylinder holders the pressure gauge view areas of each cylinder holder will permit inspection of the respective pressure gauge of the respective cylinder stored therein. Preferably the longitudinal corners (long edges) of the body are beveled for strength, rigidity and to minimize sharp corners. Preferably strengthening gussets are provided at the interior between select intersecting wall members of the body to structurally reinforce the cylinder holder. Preferably outer corner tabs and backing corner tabs are provided with a slot therebetween in close proximity to the opening at access end of the body for attachment of a restraining strap assembly. It is desirable to provide these tabs at all four (4) corners of the body at the access end to provide for selection of orientation of the restraining strap assembly depending upon specific deployment and to further strengthen the body of the cylinder holder.

Figure 4:
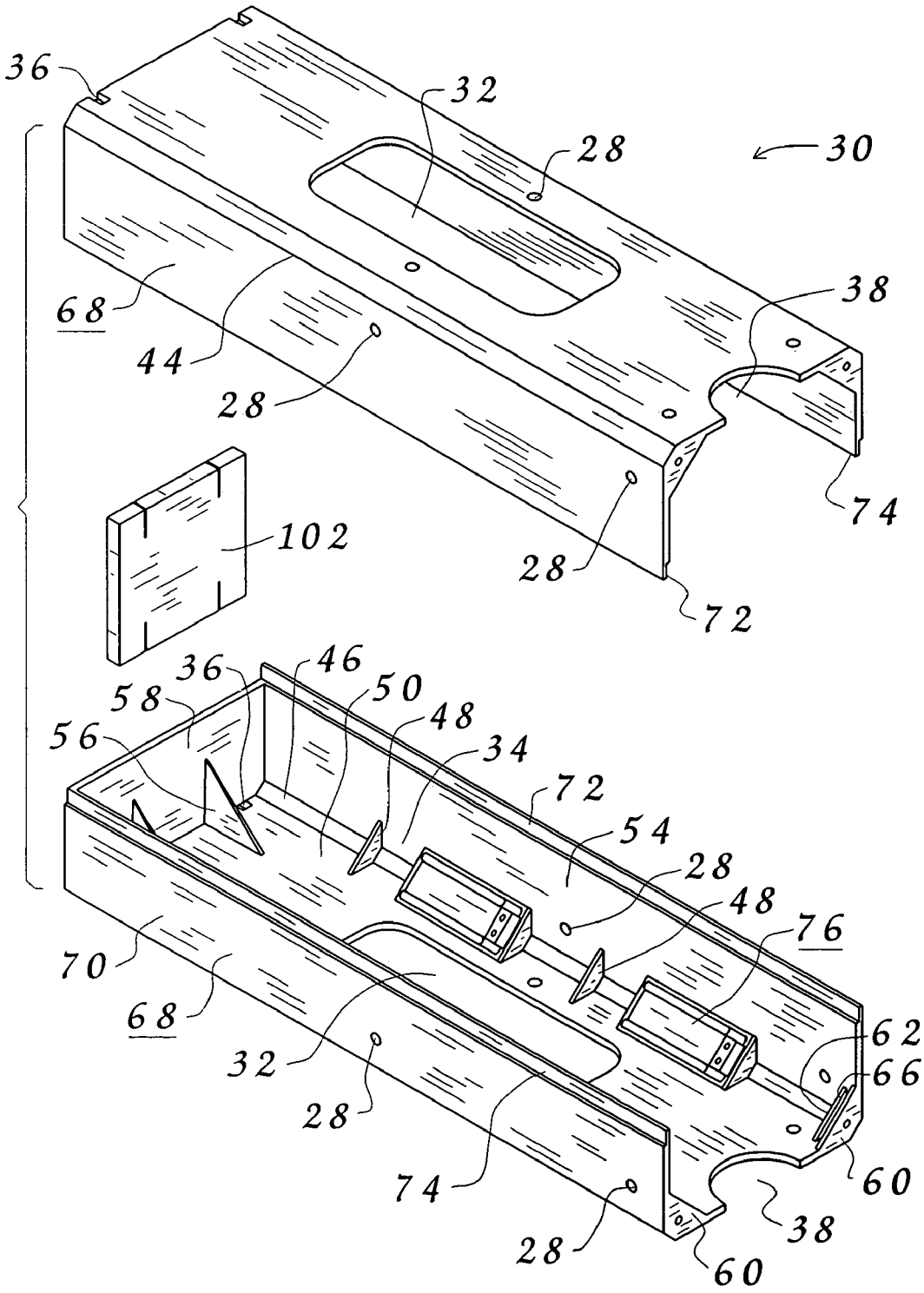
FIG. 4 is an exploded perspective view of portions of the cylinder holder shown in FIG. 1.

FIG. 4 depicts an exploded view of a body 30 which, with other components, for cylinder holder 20 shown in FIG. 1, FIG. 2, FIG. 3 and FIG. 12. Mounting apertures 28 penetrate body 30 and may be used to connect cylinder holder 20 to other structures, such as floors, walls, ceilings, doors and vehicles, to attach other components to cylinder holder 20, such as wheels, skids and handles, or to attach cylinder holder 20 to other cylinder holders to form array of cylinder holders 26, see FIG. 3. Two (2) service passageways 32 through body 30 permit ready access to an interior 34 of cylinder holder 20, see FIG. 12. Service passageways 32 may be used to install components of cylinder holder 20 in interior 34 and may be used to couple cylinder holder 20 to other cylinder holders, to components or to structures. Drainage apertures 36 through body 30 of cylinder holder 20 ensures adequate drainage of fluids from interior 34. Opposing pressure gauge view areas 38 on cylinder holder 20 permit a pressure gauge 40, see FIG. 1, of cylinder 22 to be read without requiring release of a restraining strap 42 and without requiring removal, or partial removal, of cylinder 22 from cylinder holder 20. It being noted that cylinder 22, including pressure gauge 40, remains completely within a perimeter of cylinder holder 20, and therefore protected, during the reading of pressure gauge 40. Longitudinal edges 44 of body 30 are beveled. It will be noted that this feature extends to interior 34 of body 30 in the form of coupling walls 46 which increase strength and rigidity of cylinder holder 20. Gussets 48 connecting a base wall 50, coupling wall 46 and a longitudinal wall 54 while gussets 56 connect base wall 50 and an end wall 58. These gussets, 48 and 56, significantly strengthen cylinder holder 20. An outer corner tab 60 and a backing corner tab 62 are provided at each corner at an access end 64 of body 30. A slot 66 is provided between each outer corner tab 60 and backing corner tab 62.

A preferred method of construction for the body involves forming an impact resistant ABS module shell component, utilizing an injection molding process, then forming the body by bonded together multiple of these shell components. It is possible to section the body into many shell component pieces. The use of four (4) generally identical shell component pieces is possible. Preferably two (2) generally identical shell components will be used. Each of the shell components preferably has a base wall, a first longitudinal wall extending from the base wall, a second longitudinal wall extending from the base wall opposite the first longitudinal wall and an end wall extending from the base wall and connected to the first longitudinal wall and the second longitudinal wall. The end wall is preferred but may be left open and another containment method may be employed to restrict passage of the cylinder through that opening. Preferably means to align the opposing shell components will be provided to ensure true alignment and adequate securing of the opposing shell components together. A preferred method of providing this alignment means involves placing an outer edge flange along an outer edge of the first longitudinal wall of the shell component and an outer edge flange along an outer edge of the second longitudinal wall of the shell component. This provides for the outer edge flange of the first longitudinal wall of a first shell components to mate with the outer edge flange of the second longitudinal wall of a second shell components when forming the body of the cylinder holder. This also provides for the outer edge flange of the second longitudinal wall of the first shell components to mate with the outer edge flange of the first longitudinal wall of the second shell components when forming the body of the cylinder holder. This arrangement also allows for a significant increase in contact surfaces between the opposing shell components over that obtainable with mere abutment surfaces. This provides for a strong bonding between the opposing shell components. While it is preferred that the opposing shell components be identical, in order to reduce manufacturing cost, it is possible to provide differences between the two components if desired.

Figure 12:
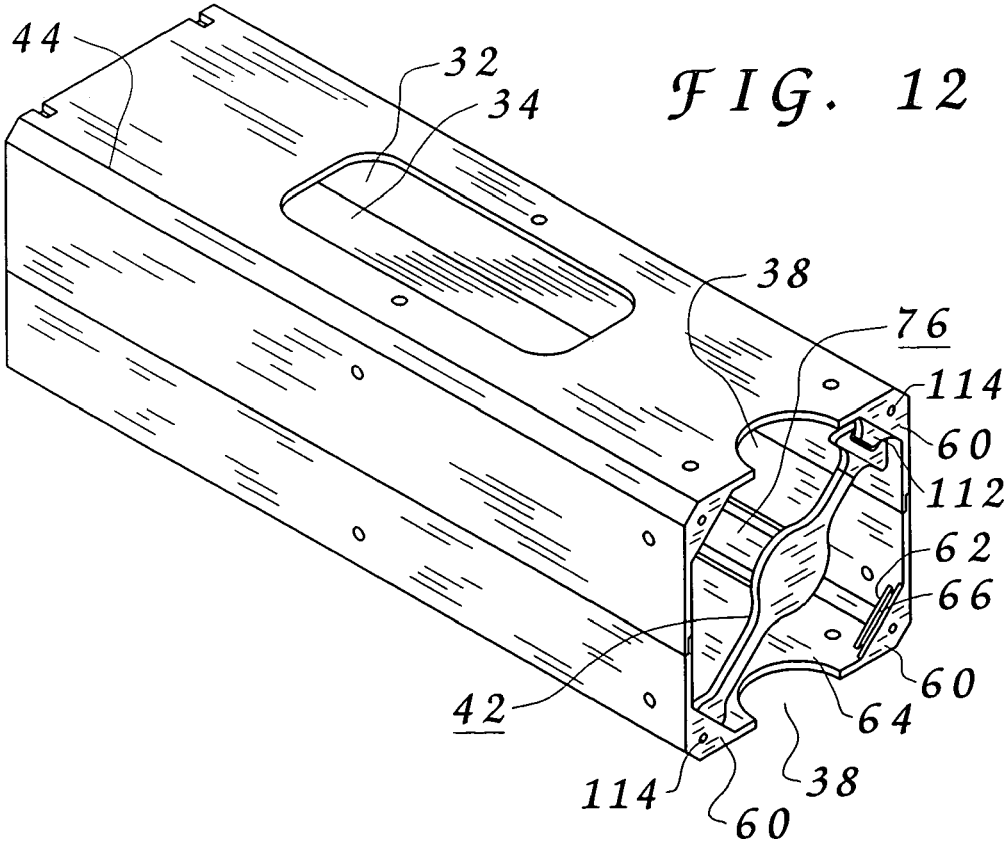
FIG. 12 is a perspective view of the assembled restraining strap and the angled coupling installed on the cylinder holder shown in FIG. 1.

FIG. 4 depicts a (first) shell component 68 positioned above a (second) identical shell component 68 prior to assembly to form body 30 of cylinder holder 20, see FIG. 1 and FIG. 12. Each shell component 68 has base wall 50, (first) longitudinal wall 54, a second longitudinal wall 70 and end wall 58. First longitudinal wall 54 has an outer edge flange 72 while second longitudinal wall 70 has an outer edge flange 74. These flanges 72 and 74 of one (first) shell component 68 mate with flanges 72 and 74 of (second) shell component 68 and are bonded together using any suitable securement method known in the art. Service passageways 32 may be employed during the coupling operation of bonding the two (2) shell components 68 together.

Slide Assemblies

Cylinder holders having features of the present invention will resiliently retain the stored cylinder in a generally central location within the body of the cylinder holder. Lateral resilient positioning means to provide this feature may be provided for with many different arrangements of structural components. The structural components which provide for this retention will allow the cylinder to move about in a three hundred and sixty (360) degree radial range away from a longitudinal central axis, or cylinder alignment axis, of the cavity of the body of the cylinder holder during periods of lateral stress. These same structural components will return the cylinder generally to the longitudinal central axis of the cavity of the body of the cylinder holder following termination of the lateral stress. This lateral stress can be from many sources and may occur with or without longitudinal stress.

Each of the automatic adjusting slide assemblies will provide means to attach the slide assembly to, or relative to, the body of the cylinder holder, will provide at least one cylinder engagement surface on a slide tab and moveable relative to the body of the cylinder holder and will provide biasing means to bias the cylinder engagement surface toward the longitudinal central axis of the body of the cylinder holder. Cylinder holders having features of the present invention will, in large part due to the automatic adjusting slide assemblies, be extremely low maintenance and have very long service lives.

The cylinder engagement surface(s) of each slide assembly provides for the stored cylinder to slide therealong. Therefore, the slide assembly will not routinely experience longitudinal stress relative to the body of the cylinder holder and the retention of the slide assemblies to, or relative to, the body may be performed by any suitable method conventionally known in the art, such as threaded nuts driven into the body. Preferably the cylinder engagement surfaces of the slide tab will be rounded and smooth and formed of a self lubricating material, as known in the art, in order to minimize any possibility of damage being inflicted upon the stored cylinder.

Each slide assembly will have a structural element, or slide tab, having at least one cylinder engagement surface thereon. Preferably opposing cylinder engagement surfaces will be positioned on each slide tab of each slide assembly where a slightly spaced apart contact occurs with the cylinder. This arrangement, by distributing the pressure applied to the exterior of the cylinder, reduces wear to the exterior of the cylinder or to the fiber wrapping of the cylinder. In order to enhance structural integrity of the slide tab outer ribs are provide on the opposing side from the cylinder engagement surface(s).

Positioning means will provide for the slide tab, with the cylinder engagement surface(s) thereon, to move relative to the body of the cylinder holder within the cavity of the body. Preferably such movement results from a hinge mounting which provides for the cylinder engagement surface(s) on a slide tab to pivot relative to a base plate which in turn is preferably attached directly to the body of the cylinder holder. Preferably the hinge point on the slide assembly is closer to the opening at the access end of the body of the cylinder holder than is the cylinder engagement surface(s). This pivotal arrangement provides for ready insertion and withdrawal of the cylinder from the cylinder holder. Alternatively, the cylinder engagement surface(s) may be mounted to move linearly toward and away from the longitudinal central axis of the body of the cylinder holder.

Each slide assembly will have some structural arrangement to provide biasing means to bias the cylinder engagement surface(s) of the slide assembly toward the longitudinal central axis of the body of the cylinder holder. A single structural element may be deployed to provide this feature to multiple slide assemblies, such as a loop member having elastic properties radially engaging multiple slide assemblies about the longitudinal central axis of the body of the cylinder holder. Even when a single bias member operates on multiple slide assemblies the biasing of each slide assembly is independent of any other slide assemblies. Preferably each slide assembly will have a dedicated biasing member or members. In the most preferred embodiment a stainless steel progressive spring is deployed for each slide assembly. Such progressive springs are known in the art and have the unique characteristic of applying a more uniform tension during compression than conventional coil springs.

Of particular interest to those entities, including the Navy, which use the fiber wrapped high pressure air cylinders is damage to the fiber wrapping of the cylinder which results from contact of the wrapping with other structures. Cutting of these fiber wrappings or abrasive wear of these fiber wrappings can significantly reduce the safe operational life of the cylinder. Cylinder holders having features of the present invention, due in part to the unique features of the slide assemblies, significantly reduce damage to cylinders compared to conventional storage methods known in the art.

A plurality of slide assemblies are positioned within the body of the cylinder holder. Preferably such deployment has two (2) staggered sets, one closer to the access end, with each set having four (4) slide assemblies radially distributed symmetrically about the longitudinal central axis of the body of the cylinder holder.

FIG. 5 depicts various components of a slide assembly 76 having a base plate 78, base plate screws 80, preferably of stainless steel, a stainless steel progressive spring 82, see FIG. 6*a* and FIG. 6*b*, a hinge mount 84 and a slide tab 88. Slide tab 88 is positioned relative to hinge mount 84 with stainless steel progressive spring 82 between slide tab 88 and base plate 78 and hinge mount 84 is secured to base plate 78 utilizing base plate screws 80. Means are provided to retain stainless steel progressive spring 82 relative to base plate 78 and slide tab 88. Base plate 78, with the completed assembly including slide tab 88, is secured to body 30 utilizing any suitable attachment method conventionally known in the art. Slide tab 88 has thereon two (2) separate cylinder contact surfaces 90, also see FIG. 1 and FIG. 2. FIG. 4 depicts two (2) slide assemblies 76 installed in body 30.

Figure 7:
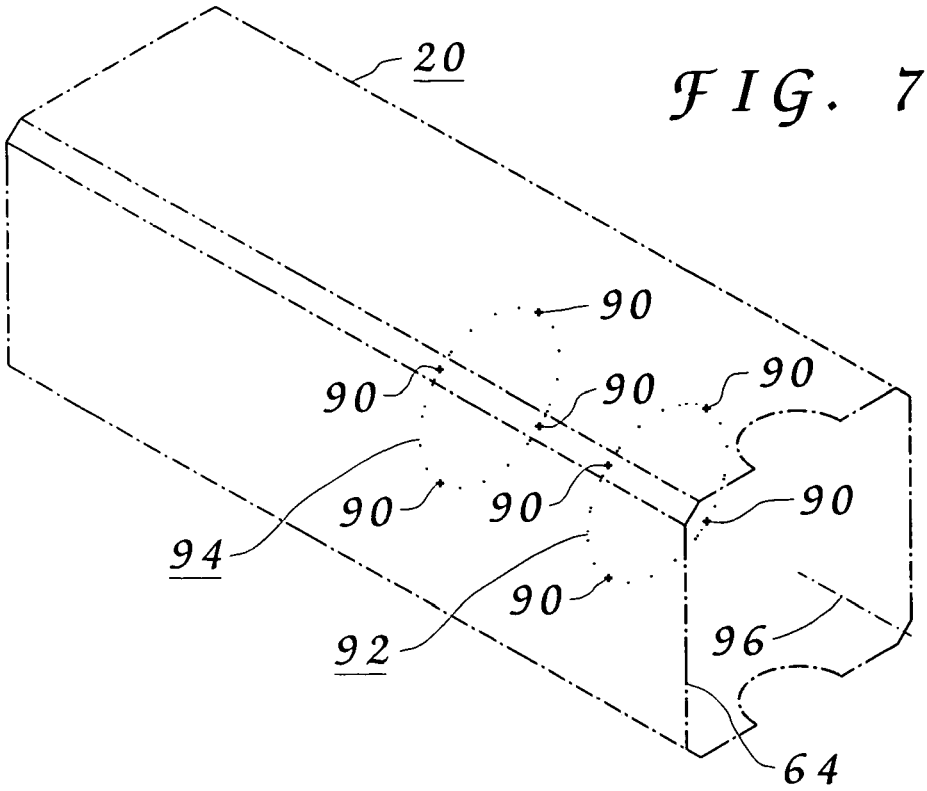
FIG. 7 is a perspective view of a representation of placement of cylinder contact surfaces.

FIG. 7 depicts a first radially positioned set 92 of cylinder contact surfaces 90 in close proximity to access end 64 of cylinder holder 20 and a second radially positioned set 94 of cylinder contact surfaces 90 further away from access end 64 of cylinder holder 20 than first set 92. This arrangement provides for cylinder holder 20 to retain a cylinder, not shown in this view, generally aligned with a longitudinal central axis 96 of cylinder holder 20.

FIG. 6*a* depicts slide assembly 76 with slide tab 88, having cylinder contact surfaces 90 thereon, in an extended orientation 97 while FIG. 6*b* depicts slide assembly 76 in a compressed orientation 98. This range of pressure bearing orientations of cylinder contact surfaces 90 in combination with staggered radial placement of a plurality of slide assemblies 76 cooperate to provide the desired resilient retention of cylinders stored within cylinder holder 20.

In order to avoid any snagging contact with radially disposed protrusions on the subject cylinder, not shown, slide tab 88 preferably has a curved end 86 having contact surfaces 90 positioned thereon. Curved end 86 provides for true non-snagging passage of any protrusions which may exist on the cylinder while slide assembly 76 is in any operational orientation including extended orientation 97 and compressed orientation 98.

While it is possible to provide for the cylinder holder to operate with cylinders having a certain set diametric measurement it is preferred to provide for use of cylinders within a range of diametric measurements. To this end the biasing means provided preferably has a range of motion sufficient to provide for the cylinder engagement surfaces to operate with various workpiece cylinders having various diametric measurements.

FIG. 1 depicts cylinder holder 20 having cylinder 22, having a diametric measurement 99, installed therein. FIG. 2 depicts cylinder holder 20 having cylinder 24, having a diametric measurement 100, installed therein. It being noted that diametric measurement 100 of cylinder 24 is significantly greater than diametric measurement 99 of cylinder 22. Cylinder holder 20 functions properly during storage of either cylinder 22, see FIG. 1, or cylinder 24, see FIG. 2.

Service passageways 32, see FIG. 4 and FIG. 12, along with access through access end 64 of body 30, provide for easy installation of, or removal and replacement, of slide assemblies 76.

Resilient Pad

It is desirable to provide for a cushioning of the base of the cylinder while stored within the cylinder holder. A highly resilient pad is installed in the interior of the body at the end wall distal from access end of the body. Suitable materials are known in the art to provide the highly resilient properties desired while being immune to harsh operating environments and the resilient pad may be formed of one of these materials. The resilient pad will be in contact with the stored cylinder while the cylinder is properly positioned and contained within the cylinder holder. This resilient pad forms part of the longitudinal resilient containment of the cylinder by the cylinder holder.

FIG. 4 depicts a resilient pad 102 prior to attachment to end wall 58 of body 30.

Retaining Strap

Cylinder holders having features of the present invention will resiliently retain the stored cylinder in a generally central location within the body of the cylinder holder. Longitudinal resilient containment means provides for a resilient containment of the cylinder stored within the cylinder holder during periods of longitudinal stress. In the most preferred embodiment the above mentioned resilient pad and a restraining strap cooperate to provide for this longitudinal resilient containment. The longitudinal stress can be from many sources and may occur with or without lateral stress.

Preferably the structure deployed at the access end of the body of the cylinder holder to longitudinally contain the stored cylinder will also provide means to release the stored cylinder from the cylinder holder. A retaining member provides for this containment and release. The retaining member is selectively positionable relative to the opening of the access end of the body. The retaining member has a blocking state and a free state relative the opening of the access end of the body. The free passage state provides for the cylinder to be moved through the opening of the access end of the body, either during insertion or removal. The blocking state provides for the cylinder to be prevented from moving through the opening of the access end of the body.

In a preferred embodiment the retaining member which provides the longitudinal resilient containment means will have elastic properties and span the opening at the access end from any select corner to the opposing corner. An elastomer strap fixedly attached to the body of the cylinder holder at a first end of the elastomer strap and releaseably attached to the body of the cylinder holder at a second end of the elastomer strap provides for both selective retention and release of the cylinder as well as, in cooperation with the opposing resilient pad, longitudinally restrains the cylinder in a resilient manner. The elastomer strap has a restricting orientation where the second end of the elastomer strap is attached to the body of the cylinder holder and a released orientation where the second end of the elastomer strap is released from the body of the cylinder holder. The elastomer strap applies a pressure to the cylinder during the resilient containment of the cylinder within the cavity of the body of the cylinder holder when the elastomer strap is in the restricting orientation. Preferably the elastomer strap has a broadened contact area proximate the longitudinal central axis of the cavity of the body when the elastomer strap is in the restricting orientation. This provides for true and complete contact with any mechanism attached to the cylinder, such as the pressure gauge, during any lateral movement of the cylinder within the cylinder holder. By broadening the contact area of the elastomer strap only at the region corresponding to the longitudinal central axis of the body the pressure gauge of the cylinder may still be read without manipulation of the elastomer strap. It is desirable to retain the cylinder within the cylinder holder under an impact delivered to the cylinder holder of ten (10) g's in any direction and the combination of the slide assemblies, the resilient pad and the elastomer strap satisfy this desire.

It is important that cylinders stored in cylinder holders having features of the present invention be easily released from the cylinder holder even when the user is wearing thick protective gloves. To this end the elastomer strap is preferably releaseably anchored to the body of the cylinder holder at an angled coupling and is of a configuration where a tension is exerted against the cylinder when the elastomer strap is retaining the cylinder. The angled coupling preferably extends inward into the interior of the cylinder holder and slightly away from the longitudinal central axis of the cylinder holder. This arrangement ensures that the elastomer strap will not inadvertently become disengaged from the angled coupling during an impact or shaking scenario. When it is desired to release the cylinder from the cylinder holder the user simply pushes inward on the elastomer strap in close proximity to the angled coupling and the elastomer strap releases and immediately falls out of the way. Then the cylinder may be grasped and pulled out of the cylinder holder for use. This operation may easily be performed even with when the user is wearing heavy protective gloves.

The elastomer strap assembly has a fixed strap mount, an elastic strap portion, a lock strap portion, the angled coupling and mount bolts. Preferably the mount bolts are stainless steel. The fixed strap mount and the lock strap portion preferably are hard molded plastic parts with securing structures, such as large opens, formed thereon. The fixed strap mount and the lock strap portion are permanently attached to opposing ends of the elastic strap portion during manufacture of the elastic strap portion with the material of the elastic strap portion passing through the securing structures for structural integrity. The fixed strap mount, with the elastic strap portion extending therefrom, is rigidly attached to the body of cylinder holder using the mount bolts at a select corner of the opening at the access end of the body of the cylinder holder. The angled coupling is rigidly attached to the body of the cylinder holder at the opposing corner of the opening at the access end of the body from the fixed strap mount using the mount bolts. Preferably the lock strap portion attached to the elastomer strap engages the angled mount at all times except when the cylinder is being inserted or removed from the cylinder holder, even when the cylinder holder is empty.

FIG. 11 depicts restraining strap 42, an elastomer strap, while FIG. 12 depicts restraining strap 42 attached to body 30 of cylinder holder 20 using slots 66 and mount bolts 114, preferably of stainless steel. A fixed strap mount 106, see FIG. 8, is positioned at one end of an elastic strap portion 108 while a lock strap portion 110, see FIG. 9, is positioned at the opposing end of elastic strap portion 108. restraining strap 42 is anchored to body 30 of cylinder holder 20, see FIG. 12, utilizing fixed strap mount 106. FIG. 10 depicts an angled coupling 112 which is anchored to body 30 of cylinder holder 20, see FIG. 12. In use lock strap portion 110 engages angled coupling 112 to restrain cylinder 22, see FIG. 1, in cylinder holder 20. An inward pressure is applied to restraining strap 42 at, or in close proximity to, lock strap portion 110 to release restraining strap 42 from angled coupling 112, see FIG. 1, to permit removal of cylinder 22 from cylinder holder 20.

Array of Cylinder Holders

Any desired number of cylinder holders may be securely connected together to form an array of cylinder holders to retain a plurality of cylinders. The mounting apertures through the body of the cylinder holder are preferably used for this purpose utilizing stainless steel nuts and bolts. Such assembly can be accomplished with a minimal number of tools. The service passageways and the opening at the access end may be employed to simplify the assembly procedure.

It is possible to provide for an array having a small number of cylinder holders, as exampled by two (2), three (3) or four (4) cylinder holders, and a carrying strap or handle for easy manipulation and transport of the array. It is possible to provide for an array having any desired number of cylinder holders and having wheels or skids attached at the base for mobile use. It is possible to provide for an array having any desired number of cylinder holders and attached to a fixed structure, such as a floor, wall or ceiling.

FIG. 3 depicts nine (9) cylinder holders 20, each having body 30, attached together utilizing stainless steel bolts 116 and opposing pairs of mounting apertures 28 of body 30 to form array of cylinder holders 26. Array of cylinder holders 26 may be used in any manner desired to store cylinders.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cylinder holder for retaining a workpiece cylinder for impact resistant storage of the workpiece cylinder, the cylinder holder having:

a) a body having a cavity, the cavity to receive the workpiece cylinder, the cavity having a longitudinal central axis generally corresponding to a longitudinal axis of the workpiece cylinder when the workpiece cylinder is positioned within the cavity during the impact resistant storage;

b) longitudinal resilient containment means to provide for a resilient containment of the workpiece cylinder within the cavity of the body of the cylinder holder during periods of longitudinal stress;

c) lateral resilient positioning means to provide for a resilient positioning of the workpiece cylinder within the cavity of the body wherein the longitudinal axis of the workpiece cylinder may move laterally within a three hundred and sixty degree radial range away from the longitudinal central axis of the cavity of the body during periods of lateral stress and return generally to the longitudinal central axis of the cavity following termination of the lateral stress.

2. The cylinder holder defined in claim 1 wherein the body is formed of two generally identical shell components, each shell component having:

a) a base wall;

b) a first longitudinal wall extending from the base wall;

c) a second longitudinal wall extending from the base wall opposite the first longitudinal wall;

d) an end wall extending from the base wall and connected to the first longitudinal wall and the second longitudinal wall.

3. The cylinder holder defined in claim 2 wherein the first longitudinal wall of each of the shell components has an outer edge flange and wherein the second longitudinal wall of each of the shell components has an outer edge flange and wherein the outer edge flange of the first longitudinal wall of a first of the shell components mates with the outer edge flange of the second longitudinal wall of a second of the shell components when forming the body of the cylinder holder and wherein the outer edge flange of the second longitudinal wall of the first of the shell components mates with the outer edge flange of the first longitudinal wall of the second of the shell components when forming the body of the cylinder holder.

4. The cylinder holder defined in claim 2 wherein the base wall of each of the identical shell components further has a service passageway therethrough to provide for ready access to the cavity of the body.

5. The cylinder holder defined in claim 1 wherein the body further comprises a plurality of drainage apertures to provide for a drainage of fluids from the cylinder holder.

6. The cylinder holder defined in claim 1 wherein a plurality of bodies are securely connected together to form an array of cylinder holders to retain a plurality of the workpiece cylinders, each of the bodies having the longitudinal resilient containment means and the lateral resilient positioning means.

7. The cylinder holder defined in claim 1 wherein the longitudinal resilient containment means further comprises an elastomer strap fixedly attached to the body of the cylinder holder at a first end of the elastomer strap and releaseably attached to the body of the cylinder holder at a second end of the elastomer strap, the elastomer strap having a restricting orientation where the second end of the elastomer strap is attached to the body of the cylinder holder and a released orientation where the second end of the elastomer strap is released from the body of the cylinder holder, the elastomer strap to apply a pressure to the workpiece cylinder during the resilient containment of the workpiece cylinder within the cavity of the body of the cylinder holder when the elastomer strap is in the restricting orientation.

8. The cylinder holder defined in claim 7 wherein the elastomer strap further comprises a broadened contact area proximate a longitudinal central axis of the cavity of the body when the elastomer strap is in the restricting orientation.

9. The cylinder holder defined in claim 1 wherein the lateral resilient positioning means further comprises a plurality of automatic adjusting slide assemblies positioned relative to the cavity of the body, each automatic adjusting slide assembly having:

a) a slide member to provide for a slidable contact with the workpiece cylinder during the storage of the workpiece cylinder within the cylinder holder;

b) positioning means to provide for the slide member to move relative to the body of the cylinder holder within the cavity of the body;

c) biasing means to provide for applying a pressure to the slide member generally toward a longitudinal central axis of the cavity of the body when the workpiece cylinder is stored within the cylinder holder.

10. The cylinder holder defined in claim 9 wherein the positioning means further comprises a pivotal coupling wherein the slide member pivots relative to the body of the cylinder holder.

11. A cylinder holder for a secure containment of a workpiece cylinder, the cylinder holder having:

a) a body having:

1) an access end having an opening;

2) an interior accessible through the opening of the access end, the workpiece cylinder generally positioned within the interior during the secure containment of the workpiece cylinder by the cylinder holder;

3) a longitudinal central axis extending through the interior;

b) a plurality of cylinder engagement surfaces positioned within the interior of the body, the cylinder engagement surfaces to provide for contact with the workpiece cylinder during the secure containment of the workpiece cylinder by the cylinder holder;

c) biasing means to independently bias each of the cylinder engagement surfaces generally toward the longitudinal central axis of the body wherein a pressure is applied to the workpiece cylinder by the cylinder engagement surfaces during the secure containment of the workpiece cylinder by the cylinder holder;

d) a retaining member selectively positionable relative to the opening of the access end of the body, the retaining member having a blocking state and a free passage state relative to the opening of the access end of the body, the free passage state to provide for the workpiece cylinder to be moved through the opening of the access end of the body, the blocking state to provide for the workpiece cylinder to be prevented from moving through the opening of the access end of the body.

12. The cylinder holder defined in claim 11 wherein pairs of the cylinder engagement surfaces are radially positioned within the interior of the body, each pair of the cylinder engagement surfaces spaced apart, each pair of the cylinder engagement surfaces generally parallel to and spaced from the longitudinal central axis of the body.

13. The cylinder holder defined in claim 12 wherein at least four pairs of the cylinder engagement surfaces are radially positioned within the interior of the body.

14. The cylinder holder defined in claim 11 wherein the cylinder engagement surfaces are pivotally connected relative to the body of the cylinder holder.

15. The cylinder holder defined in claim 11 wherein the body further comprises a pressure gauge view area at the access end of the body to provide for ready viewing of a pressure gauge of the workpiece cylinder properly positioned and contained within the cylinder holder.

16. The cylinder holder defined in claim 11 wherein the body is substantially formed from two generally identical shell components.

17. The cylinder holder defined in claim 11 wherein the body further comprises wall members generally defining the interior of the body and wherein a plurality of strengthening gussets extend between select adjacent wall members to structurally reinforce the cylinder holder.

18. The cylinder holder defined in claim 11 further comprising a resilient base pad positioned within the interior of the body distal from the access end of the body, the resilient base pad to contact the workpiece cylinder while the workpiece cylinder is properly positioned and contained within the cylinder holder.

19. The cylinder holder defined in claim 11 further comprising a plurality of mounting apertures positioned about the body wherein a plurality of cylinder holders are securely attached together utilizing the mounting apertures of each cylinder holder to form an array of cylinder holders.

20. The cylinder holder defined in claim 11 wherein the biasing means further comprises a range of motion sufficient to provide for the cylinder engagement surfaces to operate with various workpiece cylinders having various diametric measurements.

* * * * *